United States Patent [19]

Meador

[11] 4,138,920

[45] Feb. 13, 1979

[54] SNARE DRUM ATTACHMENT

[76] Inventor: David E. Meador, 2560 S. Union St., Indianapolis, Ind. 46225

[21] Appl. No.: 819,866

[22] Filed: Jul. 28, 1977

[51] Int. Cl.[2] ..... G10D 13/02

[52] U.S. Cl. ..... 84/415

[58] Field of Search ..... 84/415, 416, 417

[56] References Cited

U.S. PATENT DOCUMENTS

| | | | |
|---|---|---|---|
| 614,694 | 11/1898 | Boulanger | 84/417 X |
| 2,433,200 | 12/1947 | Cordes | 84/415 |
| 3,113,481 | 12/1963 | Thompson | 84/415 |

FOREIGN PATENT DOCUMENTS

| | | | |
|---|---|---|---|
| 1106854 | 3/1968 | United Kingdom | 84/417 |

*Primary Examiner*—Lawrence R. Franklin

*Attorney, Agent, or Firm*—Woodard, Weikart, Emhardt & Naughton

[57] ABSTRACT

A snare drum attachment comprising a first and a second bar about the same length as the snare head diameter of a snare drum, a pair of bridges mounted between the bars, a plurality of snares stretched across the bridges and defining a snare surface, vibration-absorbing pads positioned between the bridges and the snares to cushion the snares thereby preventing the transfer of vibrations to the bridges and maintaining the snares in fixed straight lines, and a supporting bar and end plate arrangement fastened to the snare drum hoop for rigidly suspending the two bars directly below and independent of the snare head. Also provided are two separate strainers for separately adjusting the vertical drop of each bridge thereby allowing independent control of the contact pressure between the snares and the snare head adjacent each bridge and a spring-loaded screw and guide pin arrangement for adjusting the tension on the stretched snares. The position of each bridge along the bars may be individually adjusted to control the span of the snare surface which contacts the snare head and a cushioned tension plate assembly is provided to further dampen all residual vibrations remaining in the snares and thereby prevent the transfer of vibrations from the stretched snares to any metal surface.

7 Claims, 8 Drawing Figures

SNARE DRUM ATTACHMENT

BACKGROUND OF THE INVENTION

1. Field of the Invention

This invention relates to snare drums and particularly to the external attachments for such drums which produce the snare sound.

2. Description of the Prior Art

The prior art is replete with many different snare drum constructions and many varied types of attachments used to produce the snare drum's characteristic sound. The following is a list of some relevant patents in this regard:

3,981,220 Clark 9/21/76
3,113,481 Thompson 12/10/63
850,306 Wanamaker 4/16/07
1,638,106 Strupe 8/09/27
1,236,667 Bower 8/14/17
2,834,244 Willits 5/13/58
609,068 Zeidler 8/16/98
2,115,741 Newberry 5/03/38
1,442,833 Soderberg 1/23/23
755,610 Bower 3/29/04
1,832,227 Ludwig 11/17/31
1,481,988 Danly 1/29/24
1,709,165 Bower 4/16/29
2,274,435 Slingerland 2/24/42
2,433,200 Cordes 12/23/47

The objectives underlying such constructions vary greatly, including the easy adjustment and throw-off of snare wires, mounting and tensioning requirements, commercial of economic feasability, and ready portability and separability of the batter and snare head. However, little effort has been directed to the improvement of the snare sound itself.

One such effort was undertaken by Thompson, U.S. Pat. No. 3,113,481, which sought to alleviate the loss of volume and tone quality due to distortion, "dead spots" and so-called "choking," which often resulted from the early use of snare beds and the stretching of the snares across the snare head thereby flattening and distorting its central portion. By utilizing a snare unit independent of the drum which provided a non-pressure, or kiss-contact with the head, Thompson sought to achieve a snare action that was always without slack, sharply defined, crisp, and free of distortion over the entire head area.

Another such effort was undertaken by Clark, U.S. Pat. No. 3,981,220, which sought to achieve a snare drum of improved tonal quality by providing a cylindrical tone ring and tubular resonating chamber assembly.

However, several problems remain still unresolved by any prior art attachments. One of the major problems within this category is that of sympathetic vibrations, or so-called after-action and "buzzing" which often occur after the note is struck on the batter head. The snare vibration caused by the vibrating snare head is transferred to the bridges or other metal snare supports thereby producing a "buzzing," or sympathetic vibration, which destroys the crispness and clarity of the snare tone. Applicant is aware of no prior art attachment which even attempts to eliminate this "buzzing" action, regardless of its success.

Another problem with prior art attachments, such as those listed above, is that generally only one bridge is adjustable for vertical drop. This means that when the snare and snare head contact is not wanted, only one bridge can be substantially dropped with the other bridge remaining close to the surface of the snare head where it might produce an unwanted snare sound. In addition, the tonal quality produced by a snare drum is directly related to the contact pressure along the entire span of the snare surface. The prior art attachments, however, generally only allow fine vertical adjustment of one snare bridge thereby often resulting in a non-uniform contact pressure across the snare surface.

Another problem with many prior art attachments is that the attachment is mounted to the drum so that the snare surface is allowed to float or move underneath the snare head. As in Clark, U.S. Pat. No. 3,981,220, and Thompson, U.S. Pat. No. 3,113,481, many connect the attachments by stretching supporting cords around the rim of the drum thereby allowing the snare unit to float free on the cords. As stated above, the tonal quality is directly related to the contact pressure along the entire span of the snare surface. This free floating of the snare unit can result in variations of this contact pressure thereby distorting the tone.

SUMMARY OF THE INVENTION

One embodiment of the present invention comprises a snare drum attachment including a first bar of about the same length as the snare head diameter of a snare drum, a pair of bridges mounted to the first bar, a plurality of snares stretched across the bridges and defining a snare surface, means for cushioning the stretched snares against the bridges, means for attaching the first bar to a snare drum directly below the snare head, and means for adjusting both the tension on the stretched snares and the vertical drop of the bridges, i.e., the distance separating the snare surface and the snare head.

By providing means for cushioning the stretched snares, the present invention eliminates all snare-to-metal contact next to the snare surface, which rides in kiss-contact with the snare head. With the residual snare vibration completely dampened, the resulting sound provides a crisp and clear tonal quality absent any "buzzing" or residual sympathetic vibration and without the "tinny" quality often resulting from metal-to-metal contact.

This cushioning action of the present invention also provides a second advantage over prior art attachments. To achieve a crisp and clear snare sound, it is necessary to maintain a fixed straight snare surface. Prior art attachments generally attempt to accomplish this by fastening the snares to plates and then stretching them or by stretching the snares around bars or grooved rollers. The present invention stretches and cushions the snares across and against a pair of bridges thereby better seating the snares and maintaining the snares in fixed straight lines across the entire snare surface. This results in a crisp and clean snare sound that greatly surpasses all prior art arrangements.

One means for adjusting the vertical drop of the two bridges usable with the present invention, as more fully discussed herein, eliminates the problems associated with single bridge adjustments by providing two strainers for separately adjusting the vertical drop of each bridge thereby allowing independent control of the contact pressure between the snares and the snare head across the entire span of the snare surface. By so doing, the resulting sound exhibits the truest tone quality and maximum volume produceable.

One manner of attaching the first bar of the present invention directly below a snare head, as more fully discussed herein, also improves upon the snare sound of prior art attachments by providing a rigid supporting bar and end plate arrangement which rigidly mounts to the snare hoop and suspends the snare attachment directly below and independent of the snare head. A constant contact pressure is thus maintained across the snare surface and virtually no distortion or tone variation is thereby encountered. By rigidly mounting the supporting bars and snare drum attachment to the snare drum hoop, the snare hoop and attachment can be readily removed in order to facilitate changing the snare head with only minor inconvenience and without disassembling the entire attachment, as required in many prior art attachments.

One object of the present invention is therefore to provide a snare drum attachment that eliminates the "buzzing," after-action and other sympathetic vibration experienced in prior art attachments because of the undampened contact between the snares and other metal surfaces.

Another object of the present invention is to provide an attachment that achieves maximum snare action and the truest tonal quality while preventing all "choking," "buzzing" and other distortion.

Another object of the present invention is to provide an attachment that maintains the snares in fixed straight lines across the entire snare surface and thereby produces a crisp and clean snare sound.

Another object of the present invention is to provide an attachment with separate adjustment of the vertical drop of each bridge thereby allowing independent control of the contact pressure between the snares and the snare head adjacent each bridge.

Another object of the present invention is to provide an attachment that is rigidly suspended directly below and independent of the snare head thereby preventing any floating or other unwanted movement by the attachment and maintaining a constant contact pressure across the entire snare surface.

Another object of the present invention is to provide an attachment that allows removal and replacement of the attachment and hoop assembly as an integral unit when removing or replacing a snare head.

Related objects and advantages of the present invention will become apparent from the following description.

DESCRIPTION OF THE PREFERRED EMBODIMENT

Figure 1:
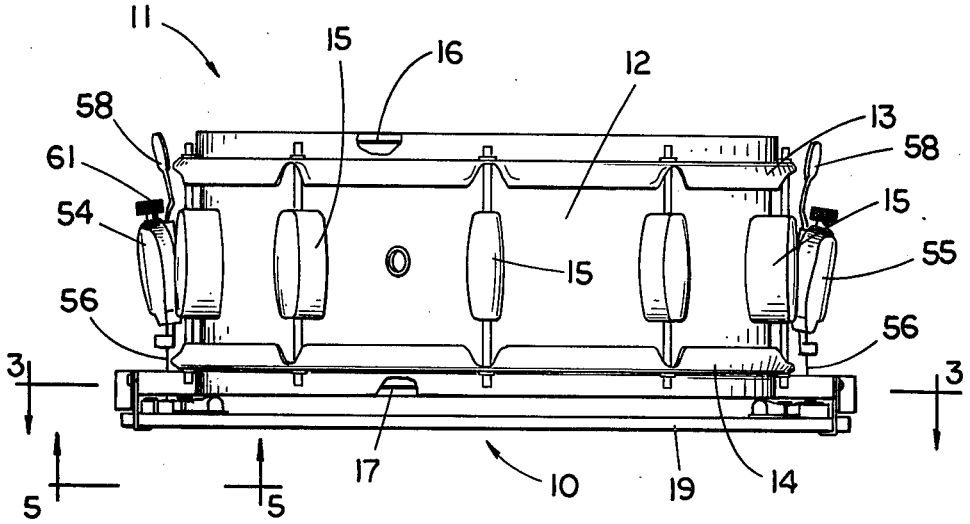
FIG. 1 is a side view of the snare drum attachment comprising the preferred embodiment of the present invention mounted to a snare drum.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
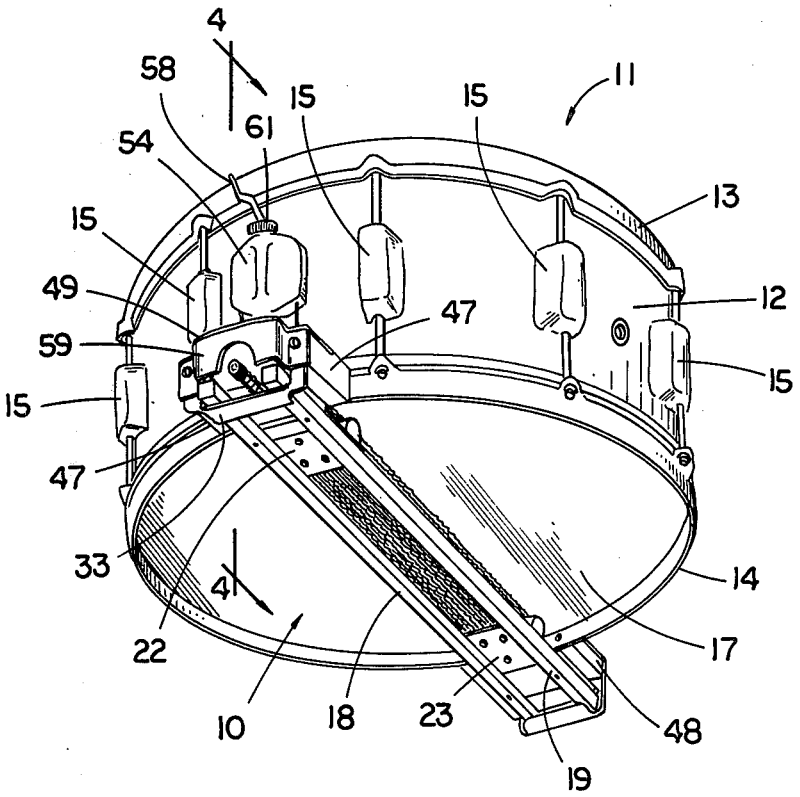
FIG. 2 is a second perspective view of the drum and attachment in FIG. 1.

Referring now to FIGS. 1 and 2, the snare drum attachment 10 comprising the preferred embodiment of the present invention is therein depicted mounted to a standard snare drum 11. The snare drum itself includes a drum shell 12 and a batter hoop 13 and snare hoop 14 which combine with a plurality of tension casings 15 to stretch the batter and snare heads 16 and 17, respectively, across the shell.

The attachment 10 comprising the preferred embodiment of the present invention is more fully depicted in FIGS. 3 through 6. The attachment first includes a pair of bars 18 and 19 which should be about the same length as the snare head diameter of the particular snare drum. Normally, this length will range from about twelve inches to about twenty inches; however, the dimensions of the specific snare drum will control the length of the given attachment.

A pair of tables or plates 22 and 23 are fixedly mounted across the two bars and a pair of bridges 24 and 25 are movably mounted to the tables 22 and 23, respectively. A plurality of snares 26 are stretched across the two bridges 24 and 25 and define a snare surface 27 which extends between the respective bridges. This surface 27 produces the characteristic snare sound when it is brought in close proximity, or "kiss-contact," to the snare head 17 as the batter head 16 is struck.

The snare ends are soldered to small snare plates 28 which are removably mounted to the upper surfaces of a pair of blocks 31 and 32. These blocks are mounted across the bars 18 and 19 between bridges 24 and 25 and two drop regulators 33 and 34, respectively. A third block 35 is mounted across the bars at one end of the attachment 10, with a spring-loaded snare tension screw 36 and a pair of guide pins 37 and 38 being provided to adjust the tension on the stretched snares as further described below.

Figure 3:
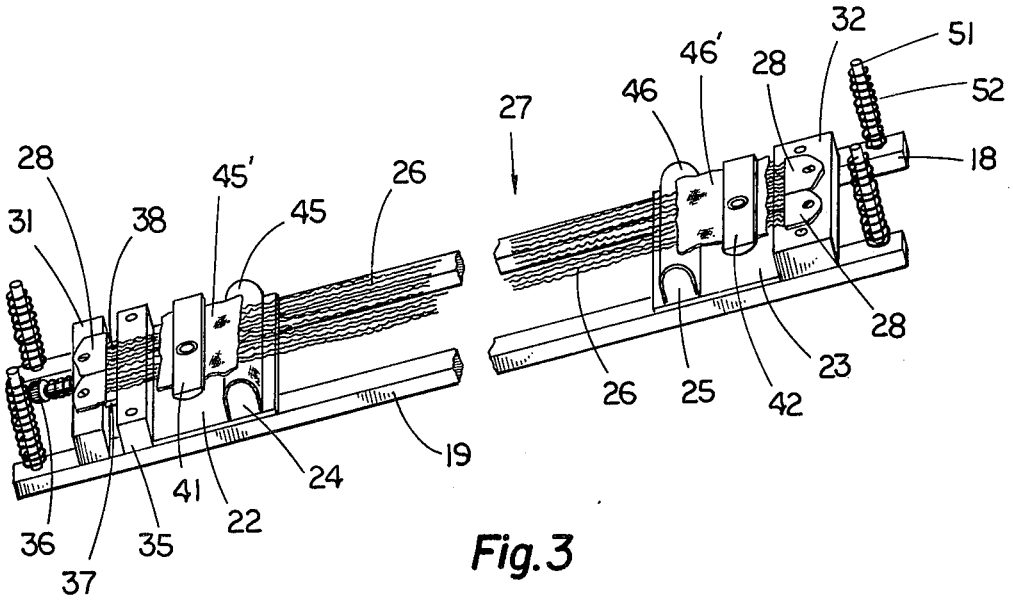
FIG. 3 is an enlarged, fragmented top view of the snare drum attachment in FIG. 1 taken along line 3—3.
Figure 4:
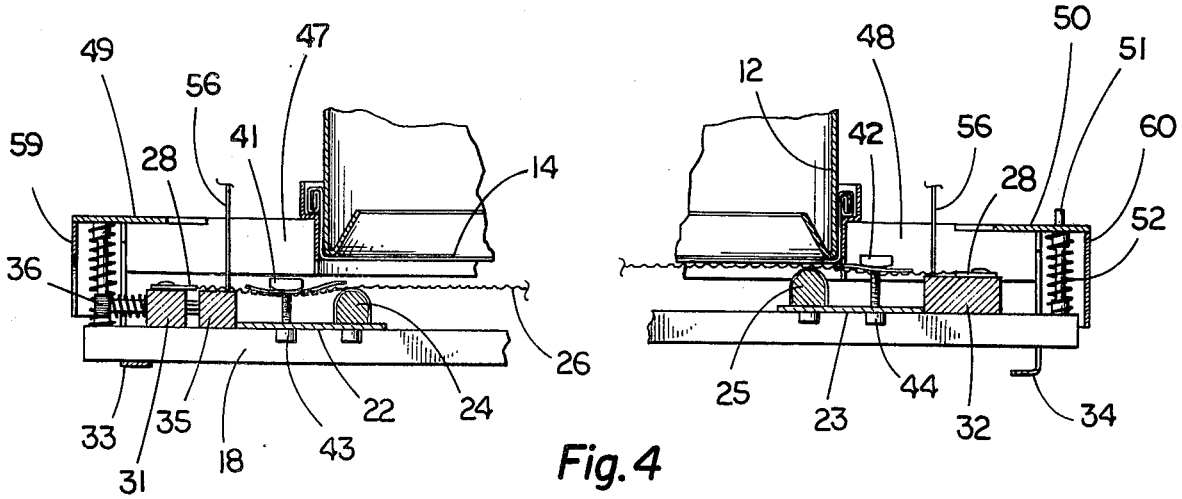
FIG. 4 is an enlarged, fragmented and part-sectional side view of the snare drum attachment in FIG. 2 taken along line 4—4, with the right portion in the up or engaged position and the left portion in the down or disengaged position.

A pair of countertension bars 41 and 42 and tension bar screws 43 and 44, as shown in FIGS. 3 and 4, are attached to tables 22 and 23 between bridges 24 and 25 and blocks 35 and 32, respectively. These countertension bars are adjustable in the vertical direction and operate to place a downward tension or force on the snares 26 as they are stretched across the respective bridges. This tension applied by the countertension bars is beneficial for two reasons. First, it aids in stretching the snares across the bridges thereby better defining the snare surface 27 and preventing the snares from contacting the snare drum shell 12. Second, the tension exerted by the countertension bars serves to eliminate the vertical component of the force exerted on the soldered snare ends as the snares are stretched across the bridges. This greatly reduces the number of snare ends which break away from the small snare plates 28 when tension is applied to the snares by adjusting snare tension screw 36.

As already stated, an important feature of the present invention is the cushioning of the snares 26 as they are stretched across bridges 24 and 25, respectively. This cushioning eliminates the "buzzing" and other sympathetic vibration while also maintaining the stretched snares in fixed straight lines across the entire snare surface and thereby achieving the crisp and true tonal quality characteristic of the present invention. Although this cushioning may be accomplished in various ways, the major concerns remain maintaining the stretched snares in fixed straight lines across the snare surface and dampening all residual vibrations remaining in the stretched snares which may distort the overall tonal quality of the drum.

In the preferred embodiment, vibration-absorbing felt pads 45 and 46 are positioned between the stretched snares 26 and the bridges 24 and 25, respectively. These pads cushion and dampen the snares thereby preventing the transfer of any residual vibrations between the snares and the bridges and maintaining the snares in fixed straight lines across the snare surface. In addition, a pair of vibration-absorbing felt pads 45' and 46' are also positioned between the stretched snares 26 and the countertension bars 41 and 42, respectively. These additional pads also extend between the stretched snares and the rim or edge of the snare shell 12 and assure the total dampening of all residual vibrations remaining in the snares after they have crossed the bridges. As stated above, many alternative means for cushioning the snares to thereby maintain them in fixed straight lines and dampen their residual vibrations may be employed and such are clearly anticipated by the present invention.

Figure 5:
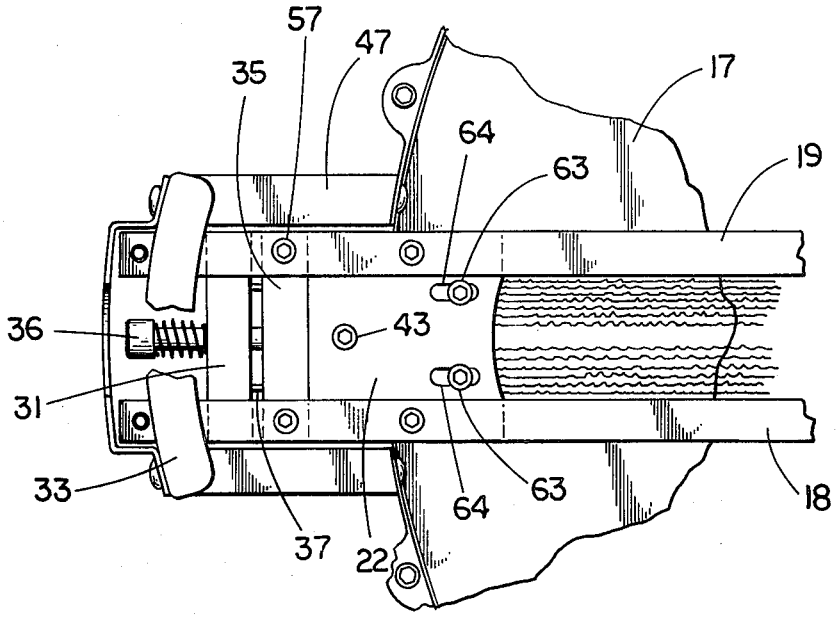
FIG. 5 is an enlarged, fragmented and part-sectional bottom view of the snare drum attachment in FIG. 1 taken along line 5—5.

The snare drum attachment 10 comprising the preferred embodiment of the present invention is rigidly suspended directly below and independent of the snare head 17 of a snare drum 11 by means of pairs of supporting bars 47 and 48 which are rigidly fastened to the snare hoop 14 as shown in FIGS. 2 and 5. A pair of top plates 49 and 50 extend across the top surfaces of supporting bars 47 and 48, respectively; and end plates 59 and 60 combine with drop regulators 33 and 34, as shown in FIGS. 4 and 6, to enclose the ends of bars 18 and 19 and thereby suspend the bar and snare assembly directly below and independent of snare head 17.

Figure 6:
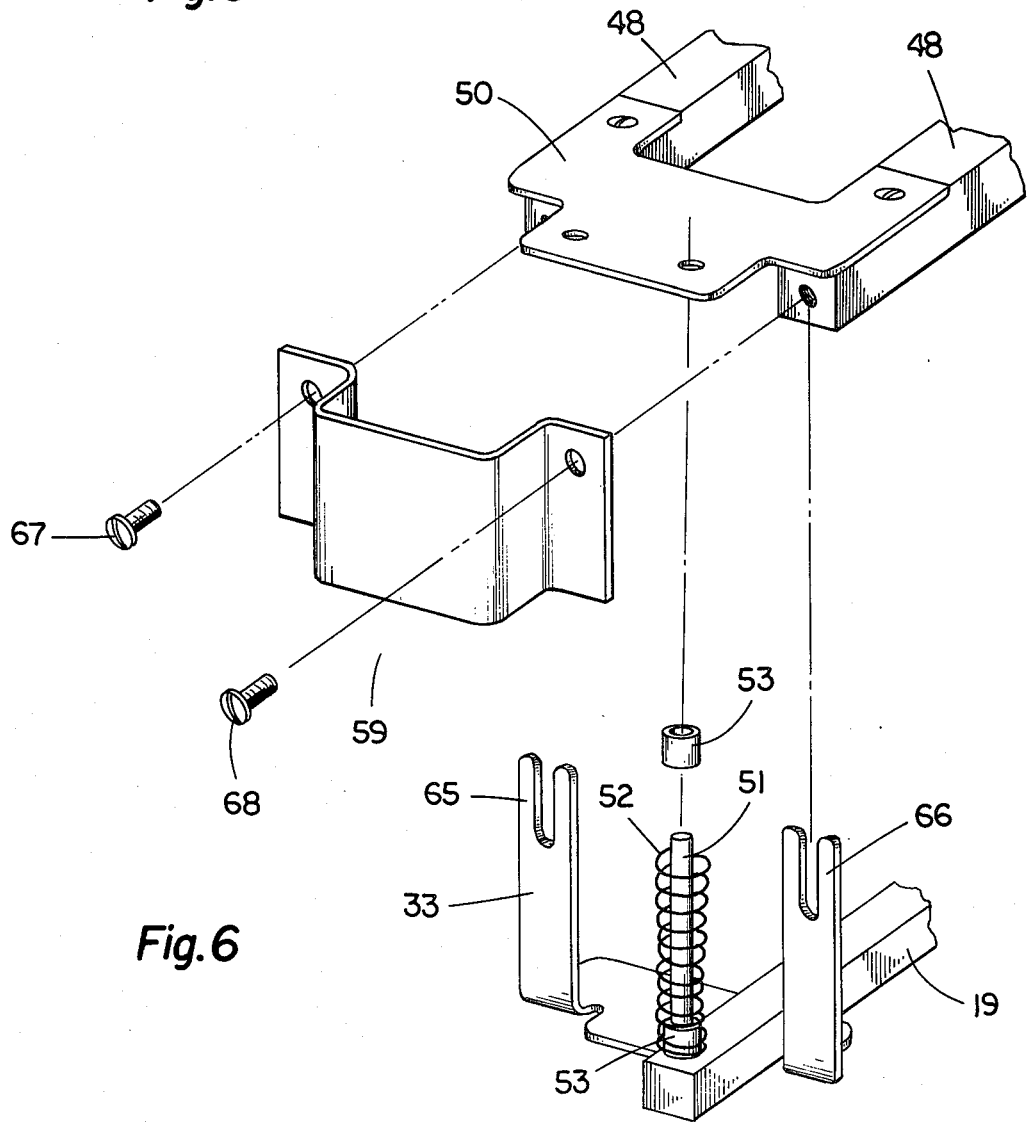
FIG. 6 is an enlarged exploded view of the right end assembly of the snare drum attachment in FIG. 1.

As shown in FIGS. 3, 4 and 6, the end of each bar 18 and 19 is connected to its respective top plate by means of a rigid pin 51 centrally located within a snare release compression spring 52 and two vibration-absorbing plastic sleeves 53. The pins 51 are imbedded in bars 18 and 19 and extend through the top plates 49 and 50 thereby allowing vertical movement of the bars within the outer restraint of drop regulators 33 and 34. However, compression springs 52 strongly resist any such upward movement of the bars in the direction of the supporting bars and top plates.

A pair of conventional snare drum strainers 54 and 55 are mounted to the snare drum shell 12 directly above and between supporting bars 47 and 48, respectively. These strainers are attached to bars 18 and 19 by means of flexible tension cables 56 which extend through holes in blocks 32 and 35 and securely fasten to bars 18 and 19 by means of attachments 57, as shown in FIG. 5. A conventional rigid rod arrangement may also be used to attach the strainers to the bar assembly; however, it is believed the flexible tension members serve to better absorb and dissipate any residual vibration thereby aiding in the elimination of the sympathetic vibrations which may distort the tonal quality. An example of two conventional snare drum strainers which may be used in the present invention is the Camco Strainer, Model No. 830, made by Camco Drum Company of Los Angeles, California, and a strainer marketed under the trademark of a Rogers Dynasonic Strainer produced by the Rogers Division of the C.B.S. Musical Instruments Co. of California.

Another feature of the dual strainer arrangement of the present invention is that the drummer may separately adjust the vertical drop of each bridge thereby allowing independent control of the contact pressure between the snares 26 and the snare head 17 adjacent each bridge. As shown in FIGS. 1 and 2, each strainer includes a lever 58 which operates to move the bridge, bar and snare assembly between two positions . . . an up or engaged position and a down or disengaged position. FIG. 4 demonstrates both of these positions, the right portion of the Figure corresponding to the engaged position and the left portion corresponding to the disengaged position. It is, of course, necessary to have the snare surface 27 engaging the snare head 17 in order to produce the characteristic snare sound. However, as previously indicated, a slight or "kiss" contact is necessary in order to produce the truest tonal quality without any areas of "choking" or other distortion. Therefore, each strainer is also provided with a fine adjustment dial 61 which can be used to independently control the contact pressure between the snares and the snare head adjacent each bridge after the lever 58 has moved the snares into the engaged position of FIG. 4.

The vertical drop of the bars 18 and 19 can also be controlled by adjusting drop regulators 33 and 34. As shown in FIG. 6, each drop regulator is provided with a pair of pronged ends 65 and 66 which slidably fit between the end plate and supporting bars. By loosening screws 67 and 68, the drop regulator can be raised or lowered a given distance thereby further adjusting the vertical drop of the bars 18 and 19.

The present invention also provides a second adjustment, already mentioned, which allows the drummer to regulate the tension on the stretched snares 26 and snare surface 27. Such adjustment only requires the use of an appropriately-sized allen wrench with the spring-loaded snare tension screw 36. By turning screw 36, block 31 is thereby horizontally moved along bars 18 and 19 thereby varying the tension on the snares as they are stretched across bridges 24 and 25. Such tension adjustment is often necessary, as when changing broken snares or when a different length or period of snare action is desired after each note is struck.

The present invention further provides a third adjustment of the distance between bridges 24 and 25 and thus the span of snare surface 27. As shown in FIG. 5, each bridge is movably mounted to its respective table 22 and 23 by means of cap screws 63 seated in elongated slots 64. Each bridge may therefore be horizontally moved a given distance along bars 18 and 19 equal to the length of these elongated slots 64 thereby varying the distance between the bridges and also the span of snare surface 27. The importance of being able to vary the snare surface is that such adjustment varies the overall magnitude and tonal quality of the snare sound. This variation is often significant when changing from one type of music to another. For example, when the snare drum is to be played with a symphony orchestra, the maximum snare surface-to-snare head contact is desired and thus also the greatest span of snare surface 27.

Figure 7:
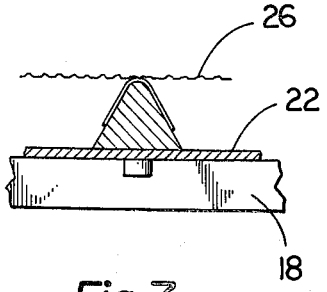
FIG. 7 is an enlarged cross-sectional end view of an alternative bridge configuration for the snare drum attachment in FIG. 1.
Figure 8:
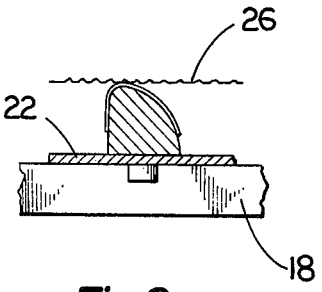
FIG. 8 is an enlarged cross-sectional end view of an alternative bridge configuration for the snare drum attachment in FIG. 1.

In the preferred embodiment of the present invention, the bridges 24 and 25 have a part-cylindrical outer configuration upon which the vibration-absorbing pad is positioned. However, many other configured bridges may also be employed in the present invention, the major concerns being to cushion the snares thereby establishing a well-defined, fixed and straight snare surface 27 while also dampening all residual vibrations in the snares as they are stretched across the particular bridge. Examples of two other acceptable configurations are shown in FIGS. 7 and 8.

Another feature of the present invention is that, unlike many prior art attachments, the present invention need not be disassembled while removing and replacing a damaged snare head 17. By rigidly mounting the supporting bars and thus the attachment to the snare drum hoop 14, the only required step before replacing the damaged head is to disengage the flexible tension cables 56 from the strainers 54 and 55 and then to remove the hoop 14 as would normally be done with prior art drums and attachments. The snare attachment is thus removable as one integral unit with the hoop 14 and the snare head can thus be readily removed and replaced with only minor inconvenience and without disassembling the entire attachment.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A snare drum attachment comprising:

(a) a first bar of about the same length as the snare head diameter of a snare drum;

(b) a pair of bridges mounted to said first bar;

(c) a plurality of snares stretched across said bridges and defining a snare surface;

(d) means for cushioning said stretched snares against said bridges;

(e) means for attaching said first bar to a snare drum directly below the snare head;

(f) means for adjusting the vertical drop of said bridges thereby adjusting the distance separating the snare surface and the snare head; and (g) means for adjusting the tension on said stretched snares, said means for cushioning comprising a pair of vibration-absorbing pads, one of said pads being positioned between said stretched snares and each of said bridges thereby preventing the transfer of vibrations between said snares and said bridges and maintaining said stretched snares in fixed straight lines across the snare surface, said means for cushioning additionally comprising a pair of countertension bars positioned outside said bridges and being vertically adjustable to stretch said snares downwardly across said bridges thereby defining the snare surface, said counter-tension bars including vibration- absorbing pads positioned between said stretched snares and said countertension bars to dampen all residual vibrations remaining in said snares and thereby prevent the transfer of residual vibrations between said snares and said countertension bars.

2. A snare drum attachment comprising:

(a) a first bar of about the same length as the snare head diameter of a snare drum;

(b) a pair of bridges mounted to said first bar;

(c) a plurality of snares stretched across said bridges and defining a snare surface;

(d) means for cushioning said stretched snares against said bridges, said means for cushioning comprising a pair of vibration-absorbing pads, one of said pads being positioned between said stretched snares and each of said bridges thereby preventing the transfer of vibrations between said snares and said bridges and maintaining said stretched snares in fixed straight lines across the snare surface;

(e) means for attaching said first bar to a snare drum directly below the snare head;

(f) means for adjusting the vertical drop of said bridges thereby adjusting the distance separating the snare surface and the snare head, said means for adjusting the vertical drop comprising means for separately adjusting the vertical drop of said bridges thereby allowing independent control of the contact pressure between said snares and the snare head adjacent said bridges, said means for separately adjusting comprising a pair of strainers mounted to the snare drum shell, said strainers being connected to opposite ends of said first bar and operable to separately adjust the vertical drop of said bridges;

(g) means for adjusting the tension on said stretched snares;

(h) a second bar of about the same length as said first bar and mounted parallel to said first bar, said bridges being attached between and across said first and said second bars, said means for attaching comprising means for fixedly attaching said first and said second bars to a snare hoop on a snare drum and for rigidly suspending said first and said second bars directly below and independent of the snare head, said means for attaching being in a manner which would not interfere with removal of a conventional snare drum hoop, said means for fixedly attaching and for rigidly suspending comprising:

(i) a plurality of supporting bars;

(ii) a plurality of end plates enclosing the outer ends of said supporting bars and said first and said second bars;

(iii) spring means including snare release compression springs, rigid central pins and vibration-absorbing sleeves for repellingly connecting said supporting bars and said first and said second bars thereby resisting movement of said first and said second bars in the direction of said supporting bars; and (iv) means for rigidly fastening said supporting bars to the snare hoop of a snare drum;

(i) a pair of blocks mounted to said first and said second bars between said bridges and said end plates, the ends of said snares being securedly attached to the upper surfaces of said blocks, said strainers being attached through said blocks to said first and said second bars by means of flexible tension members;

(j) a pair of countertension bars positioned between said bridges and said blocks, said countertension bars being vertically adjustable to stretch said snares downwardly across said bridges thereby defining the snare surface, said countertension bars including vibration-absorbing pads positioned between said stretched snares and said countertension bars to dampen all residual vibrations remaining in said snares and thereby prevent the transfer of residual vibrations between said snares and said countertension bars;

(k) and a pair of tables, said bridges and said countertension bars being mounted on said tables, said bridges also being horizontally movable along said tables and said first and said second bars thereby varying the distance between said bridges and the span of the snare surface.

3. The attachment of claim 2 in which said means for adjusting the tension comprises:

(a) a third block mounted to said first and said second bars adjacent one of said pair of blocks;

(b) a spring-loaded snare tension screw;

(c) and a pair of guide pins, said screw extending through said third block and being adapted to horizontally move the adjacent one of said pair of blocks along said first and said second bars thereby varying the tension on said stretched snares.

4. The combination comprising:

(a) a snare drum;

(b) and the snare drum attachment of claim 3 mounted to said drum.

5. The combination comprising a snare drum and a snare drum attachment mounted to said drum, said snare drum attachment comprising:

(a) a first bar of about the same length as the snare head diameter of said snare drum;

(b) a pair of bridges mounted to said first bar;

(c) a plurality of snares stretched across said bridges and defining a snare surface;

(d) means for cushioning said stretched snares against said bridges;

(e) means for attaching said first bar to said snare drum directly below the snare head;

(f) means for adjusting the vertical drop of said bridges thereby adjusting the distance separating the snare surface and the snare head; and (g) means for adjusting the tension on said stretched snares, said means for cushioning comprising a pair of vibration-absorbing pads, one of said pads being positioned between said stretched snares and each of said bridges thereby preventing the transfer of vibrations between said snares and said bridges and maintaining said stretched snares in fixed straight lines across the snare surface, said means for cushioning additionally comprising a pair of countertension bars positioned outside said bridges and being vertically adjustable to stretch said snares downwardly across said bridges thereby defining the snare surface, said countertension bars including vibration-absorbing pads positioned between said stretched snares and said countertension bars to dampen all residual vibrations remaining in said snares and thereby prevent the transfer of residual vibrations between said snares and said countertension bars.

6. The combination of claim 5 in which said means for adjusting the vertical drop comprises means including a pair of strainers mounted to the snare drum shell for separately adjusting the vertical drop of said bridges thereby allowing independent control of the contact pressure between said snares and the snare drum head adjacent said bridges.

7. The combination of claim 6 in which said means for attaching comprises means including supporting bars for fixedly attaching said first bar to a snare hoop on a snare drum and for rigidly suspending said first bar directly below and independent of the snare head, said means for attaching being in a manner which would not interfere with removal of a conventional snare drum hoop.

* * * * *